US005799575A

United States Patent [19]

Airoldi

[11] Patent Number: 5,799,575

[45] Date of Patent: Sep. 1, 1998

[54] PRINTING MACHINE WITH TURNTABLE

[75] Inventor: Frederic Airoldi, Servon, France

[73] Assignee: Societe d'Exploitation des Machines Dubuit, Noisy Le Grand, France

[21] Appl. No.: 851,340

[22] Filed: May 5, 1997

[30] Foreign Application Priority Data

May 3, 1996 [FR] France ..... 96 05577

[51] Int. Cl.[6] ..... B41F 33/00; B41F 17/00

[52] U.S. Cl. ..... 101/41; 101/35

[58] Field of Search ..... 101/35, 41, 44

[56] References Cited

U.S. PATENT DOCUMENTS 5,490,456 2/1996 Richardson et al. ..... 101/35
5,520,107 5/1996 Airoldi ..... 101/35

FOREIGN PATENT DOCUMENTS 2714867 1/1994 France .
7400054 7/1975 Netherlands ..... 101/35

*Primary Examiner*—Edgar S. Burr
*Assistant Examiner*—Amanda B. Sandusky
*Attorney, Agent, or Firm*—Young & Thompson

[57] ABSTRACT

A printing machine including a turntable causes object supports to pass at least one printing station. According to the invention, a guard is mounted mobile with respect to the printing station, and under the control of a control device driven by a control unit accessible to the operator, can move from a retracted position, in which it leaves the turntable readily accessible, to an extended position, in which it overlaps the turntable. Application, in particular, to printing machines with screen print heads.

27 Claims, 2 Drawing Sheets

PRINTING MACHINE WITH TURNTABLE

BACKGROUND OF THE INVENTION

1. Field of the invention

The present invention generally concerns printing machines of the kind including a turntable, rotatable under the control of a control device and which, holding a series of object supports each adapted to hold an object to be printed, causes the object supports to pass at least one printing station containing a print head adapted to apply printing to an object present on such an object support.

2. Description of the prior art

Normally in practice, and this is the case when printing the objects concerned involves the successive application to them of several colors, and/or when several objects are printed simultaneously, there are several printing stations mounted around the axis of the turntable, alternating, in general, with drier stations.

However, current safety regulations require there to be arrangements that prevent an operator from carrying out any operation on the printing machine when it is in motion, in order to protect the operator from interfering in any way with the rotating part of the printing machine, which, in practice, is limited to its turntable and the object supports held by the turntable.

It has therefore been proposed for this purpose to equip such a printing machine with a general cover fastened to its frame with, for each printing station, or, in some cases, for a group of printing stations, a gate, movable with respect to the frame, that controls access to such a printing station, and to which is interlocked a protection circuit controlling the control device of the turntable.

When the gate is opened for any reason, the turntable is halted and, with it, the whole printing machine.

This arrangement, which is satisfactory, has the disadvantage of leading on each occasion to a reduction in productivity.

It has been found, at least for certain operations and this applies to adjustments that are sometimes inevitably required to one of the print heads, that these operations can be performed without the turntable necessarily being halted.

A general object of the present invention is an arrangement which, whilst satisfying safety regulations, makes it possible in such a case to keep the printing machine in operation, thereby enhancing productivity.

SUMMARY OF THE INVENTION

The object of the invention is a printing machine of the kind including a turntable, rotatable under the control of a control device and which, holding a series of object supports each adapted to hold an object to be printed, causes the object supports to pass at least one printing station containing a print head, wherein a guard that is mounted mobile in a radial direction at the printing station, above and in the vicinity of the turntable, and which, under the control of a control device driven by a control unit accessible to the operator, can move from a retracted position, in which it leaves the turntable readily accessible around the print head, to an extended position in which, on the contrary, it overlaps the turntable at least locally at this level.

For example, the guard implemented according to the invention includes a plate which, in its extended position at least, is substantially parallel to the turntable, and the lateral edges of which are substantially parallel to the radius of the turntable along which the print head is mounted, and, more commonly, it is no more than such a plate.

However, because of its proximity to the turntable and its relative coverage over it, when it is in its extended position the guard implemented according to the invention can advantageously and in complete safety prevent the operator interfering with the turntable in any way, which allows the operator to work on the print head without danger even though the turntable is in motion.

Thus, according to one embodiment of the invention, when the printing station includes a gate which, movable with respect to the frame of the whole assembly, controls access to the printing station, and to which is interlocked a protection circuit controlling the control device of the turntable, it is advantageously possible to include additionally interconnection means for taking the protection circuit of the printing station out of service when the guard moves from its retracted position to its extended position.

Indeed, the purpose of the protection circuit of the printing station is still satisfied, even when the protection circuit has been deliberately taken out of service.

In other words, the guard implemented according to the invention advantageously enables apparently contradictory safety and productivity requirements to be reconciled simply and securely.

Preferably, when two printing stations are working near each other and each of them is equipped with a guard according to the invention, in the retracted position, the corresponding plates overlap one another locally, in similar fashion to the sectors of an iris diaphragm in a photographic lens.

Guards according to the invention can thus advantageously be implemented for all the printing stations within the limits of the space available in the central area of the turntable, without entailing an increase in the size of the whole assembly.

The features and advantages of the invention will emerge from the following description given by way of example with reference to the appended diagrammatic drawings.

DETAILED DESCRIPTION OF THE PREFERRED EMBODIMENTS

Figure 5:
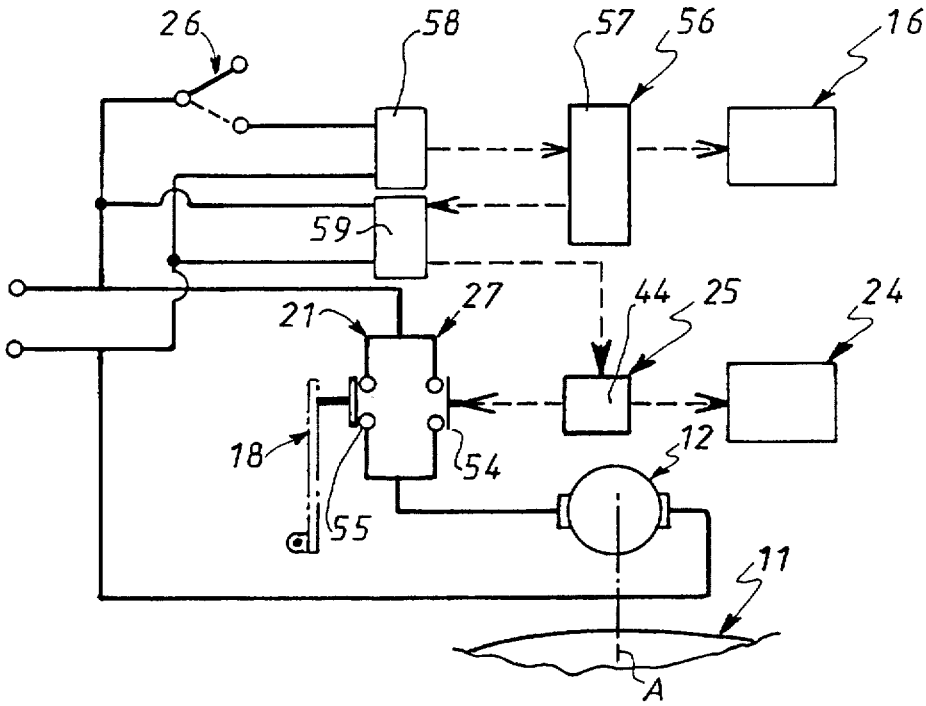
FIG. 5 is a block diagram that illustrates its operation.

As shown in the figures, and in a manner known in itself, the printing machine 10 according to the invention includes a turntable 11, rotatable about its axis A under the control of a control device 12 shown in diagrammatic form in FIG. 5 and which, holding a series of object supports 13 each adapted to hold an object to be printed (not shown), for example a compact disc, causes the object supports 13 to pass at least one printing station 15 containing a print head 16.

In practice, several printing stations 15 are arranged around the axis A of the turntable 11, at regular or irregular angular intervals, and they alternate with drier stations 17.

In practice, too, the turntable 11 has a circular contour.

For simplicity, its control device 12 is shown diagrammatically by the representation of a motor in FIG. 5.

However, it is a control device that can operate stepwise, to stop each of the object supports 13 at right angles to each of the printing stations 15 and each of the drier stations 17.

Figure 1:
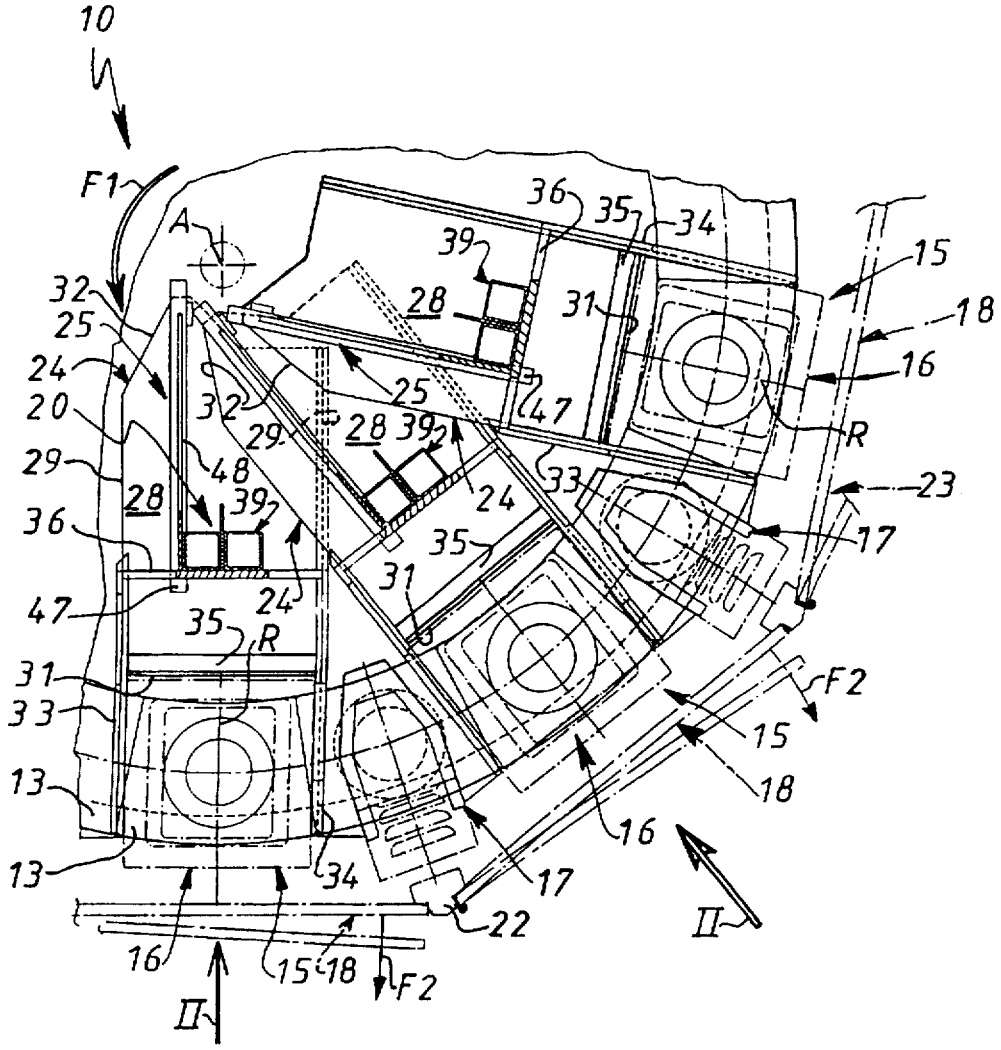
FIG. 1 is a partial plan view of a printing machine according to the invention, on the line I—I in FIG. 4.

In FIG. 1, the arrow F1 indicates the direction of rotation of the turntable 11.

In the embodiment shown, the object supports 13 project slightly beyond the upper edge of the turntable 11.

The print head 16 in each of the printing stations 15 is, for example, a screen print head.

Figure 4:
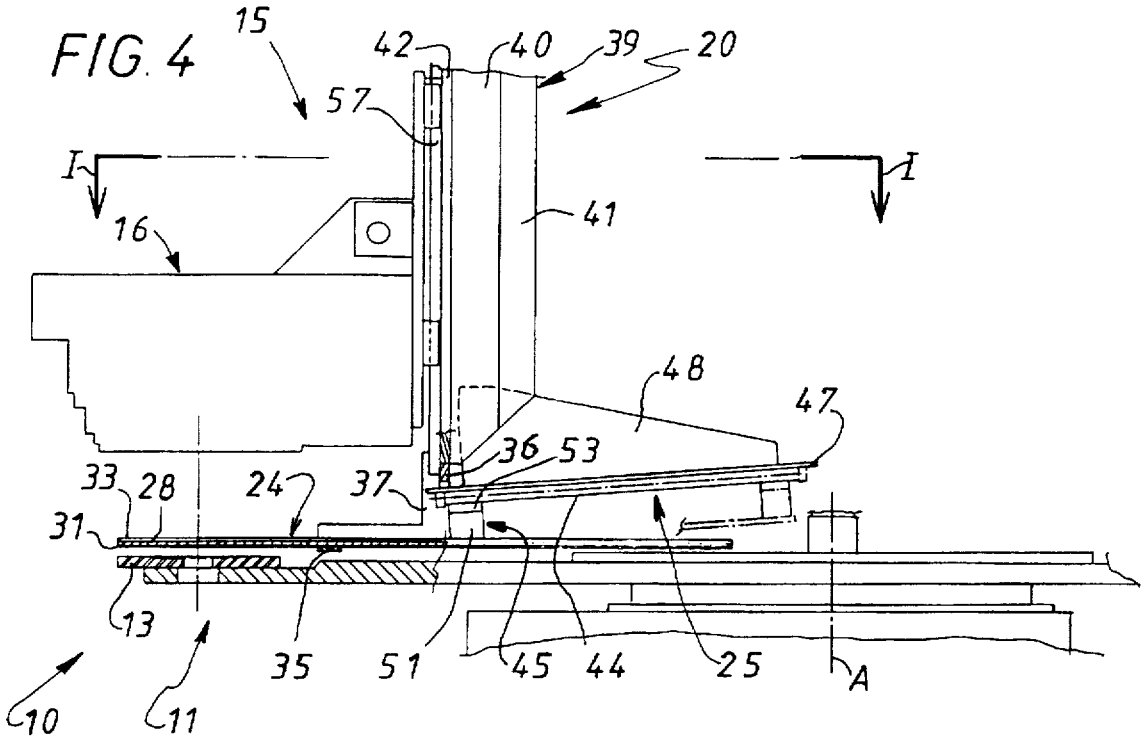
FIG. 4 is a partial cross-sectional view of the printing machine according to the invention, on the line IV—IV in FIG. 2.

Such a print head 16, being well known in itself, and not in itself relevant to the present invention, has been shown only diagrammatically in chain-dotted outline in FIG. 1 and in continuous outline representing its contour in FIG. 4, and will not be described here.

The same applies to the drier stations 17, which are, for example, ultraviolet radiation drier stations.

In a manner known in itself, and as shown diagrammatically in chain-dotted outline in FIGS. 1 and 5, there is associated with at least one of the printing stations 15 and, in practice, with each of them, a gate 18 which, movable with respect to the frame 20 of the whole assembly, controls access to such a printing station 15, and to which is interlocked a protection circuit 21 controlling the control device 12 of the turntable 11.

The frame 20 being known to those skilled in the art, and not in itself relevant: to the present invention, is not described in detail here.

Only those elements of it required for an understanding of the invention will be described in greater detail later on.

As shown diagrammatically by the arrows F2 for two of them in FIG. 1, the gates 18 controlling access to the printing stations 15 can be mounted pivotably about frame members 22 which, fastened to the frame 20, form part of a cover 23 surrounding the turntable 11 at a distance.

Preferably, there is a gate 18 for each printing station 15, but, of course, in a variant of the invention a single gate 18 can be common to two or more printing stations 15.

According to the invention, at least one of the printing stations 15 and preferably each of them, contains a guard 24 mounted mobile in a radial direction to the printing station, above and in the vicinity of the turntable 11, and which, under the control of a control device 25 driven by a control unit 26 accessible to the operator, can move from a retracted position shown in continuous outline in FIG. 1 and in chain-dotted outline in FIG. 4, in which it leaves the turntable 11 readily accessible around the print head 16, to an extended position in which, on the contrary, it overlaps the turntable 11 at least locally at this level.

For example, and as shown, the guard 24 according to the invention includes a plate 28 which, in its extended position at least, is substantially parallel to the turntable 11, and the lateral edges 29 of which are substantially parallel to the radius R of the turntable 11 along which the print head 16 is mounted.

In practice, in the embodiment shown, the guard 24 is no more than such a plate 28 and, preferably, it is a plate made of translucent material.

For example, it is a plate made of a synthetic material of the type marketed under the trade name "PLEXIGLASS".

Circularly, that is from one to the other of its lateral edges 29, the plate 28 overlaps the turntable 11 to a very substantial extent, corresponding at least substantially to the coverage of the print head 16 over it, and extending from it symmetrically on either side of the radius R concerned of the turntable 11.

In a radial direction, that is from one to the other of its transverse edges 31, 32, the plate 28 extends over only a fraction of the radius R, preferably more than half.

From the side of the peripheral edge of the turntable 11, its transverse edge 31 is straight, extending perpendicularly to the lateral edges 29, and, preferably, when the guard 24 is in its extended position, the transverse edge 31 extends at least level with the radially outermost edge of the object support 13 present in the printing station 15.

In this extended position, the plate 28 therefore extends in a radial direction beyond the peripheral edge of the turntable 11 in the embodiment shown.

At the end near the axis A of the turntable 11, the transverse edge 32 of the plate 28 is angled to save space.

Each of the lateral edges 29 of the plate 28 which the guard 24 according to the invention thus includes, is preferably associated with a guide 33, 34 fastened to the frame 20 of the whole assembly.

In the embodiment shown, and for reasons which will emerge subsequently, for one of the lateral edges 29, for example that furthest upstream in the direction of rotation of the turntable 11 identified by the arrow F1 in FIG. 1, this is a guide 33 which has an L-shape cross-section, and on which the plate 28 simply rests.

For the other of the lateral edges 29, and, therefore, that furthest downstream in the direction of rotation of the turntable 11, it is a guide 34 which has a recumbent U-shape cross-section, the concave part of which is turned towards the previous guide 33, and with which the edge of the plate 28 is engaged.

While the guide 33 is relatively short, extending over only a fraction of the radius R of the turntable 11 substantially equal to half counting from the peripheral edge of the turntable 11, the guide 34 is longer, extending over almost all the radius R counting from the peripheral edge of the turntable 11.

In the embodiment shown, the guides 33, 34, which are of course parallel, are linked by two cross-members 35, 36.

The cross-member 35 extends over their lower surface, substantially two-thirds of the length of the guide 33 counting from the peripheral edge of the turntable 11, to avoid interfering with the print head 16.

The cross-member 36 overhangs the guides 33, 34, and is connected to them by brackets 37 at its ends, and extends to the radially innermost end of the guide 33.

In practice, in the embodiment shown, the guides 33, 34 connected to one another in this way are generally at the end of a suspending rod 39, which, fastened to the frame 20 of the whole assembly, overhangs the turntable 11, and to which the cross-member 36 is duly secured.

For example, and as shown, the suspending rod 39 is formed from two small columns 40, of square cross-section, between which is inserted a plate 41, to which is abutted a plate 42 at right angles to the previous plate 41.

Taking into account that, in the embodiment shown, two successive printing stations 15 are inevitably near one another and that each of them is equipped with a guard 24 according to the invention, it is preferably arranged that, in the retracted position, the corresponding plates 28 overlap one another locally to take account of the small amount of room available for them in the central area of the turntable 11.

In the embodiment shown, the control device 25 of each of the guards 24 includes an actuating cylinder 44, in practice a double action cylinder, with the piston, not visible, of which the plate 28 of such a guard 24 is constrained to move in unison by a coupling 45, according to arrangements described hereinafter.

The actuating cylinder 44 extends parallel to a plane which, perpendicular to the turntable 11, passes through the corresponding radius R of the turntable 11.

In the embodiment shown, it is fixed lengthwise to a plate 47, and, through the plate 47 and a plate 48 at right angles to it, it is fixed to the suspending rod 39, engaged under the cross-member 36 and extending substantially from this cross-member 36 to the vicinity of the axis A of the turntable 11.

The actuating cylinder 44 is, for example, a rodless cylinder of the type sold under the brand name "ORIGA".

According to the invention, the overlap required for the plates 28 in the central area of the turntable 11 results from the fact that the actuating cylinder 44 extends obliquely with respect to the turntable 11, separating from it as it moves away from its peripheral edge.

Figure 2:
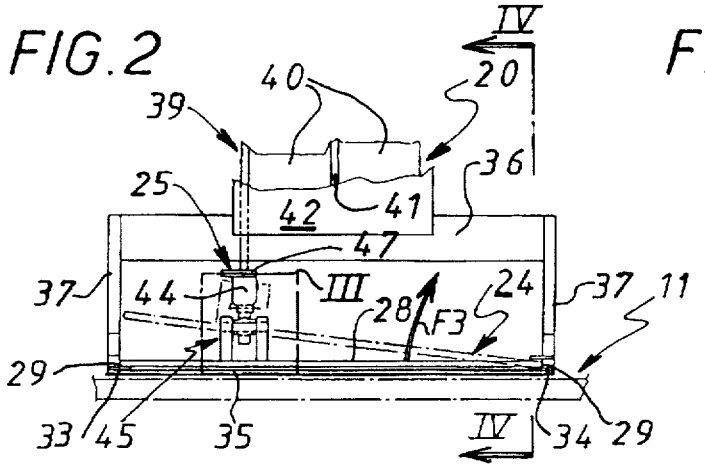
FIG. 2 is a partial elevation view, partly cut away, in the direction of the arrow II in FIG. 1.
Figure 3:
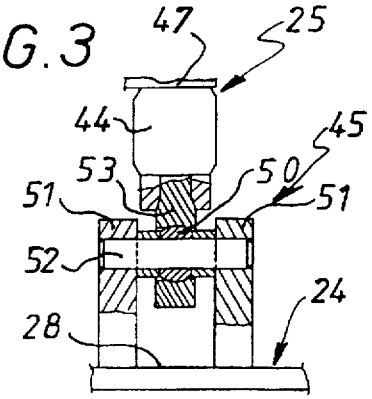
FIG. 3 shows the detail of the part of FIG. 2 identified by III, to a larger scale.

It is to take into account this obliqueness that the guide 33 has an L-shape cross-section, so that, gradually raised by the actuating cylinder 44, the plate 28 can come away from the guide 33, as shown in chain-dotted outline in FIG. 2.

In the embodiment shown, the actuating cylinder 44, which runs parallel to the lateral edges 29 of the plate 28, is off-centered with respect to the plate 28, extending closer to that of its lateral edges 29 with which the guide 33 with an L-shape cross-section is associated than the other of the lateral edges 29.

The angled part of the corresponding transverse edge 32 of the plate 28 is itself off-centered as a consequence.

In practice, this angled part is where the coupling 45 is inserted.

In other words, the coupling 45 acts from the side of the radially innermost transverse edge 32 of the plate 28.

Preferably, to take into account the raising of the plates 28 needed for them to overlap, the coupling 45 includes a ball 50.

To be more precise, in the embodiment shown, the coupling 45 has two parallel lugs 51 that are fastened to the plate 28 concerned and are linked by a spindle 52, and the ball 50 is positioned between the spindle 52 and a lug 53 which, intermediate between the lugs 51, is itself fastened to the piston of the corresponding actuating cylinder 44.

According to the invention, interconnection means 27 are also provided for taking the protection circuit 21 of a printing station 15 out of service when the corresponding guard 24 is in its extended position.

In the embodiment shown, the interconnection means 27 comprise a switch 54, for example a microswitch controlled by the actuating cylinder 44 belonging to the control device 25 of the guard 24, as shown in dashed outline in FIG. 5, and which, interposed on the electrical power supply of the control device 12 of the turntable 11 is inserted in parallel with the protection circuit 21.

Consequently, and as shown, the protection circuit 21 can itself very simply include a switch 55, for example a microswitch, controlled by the corresponding gate 18, as shown in chain-dotted outline in FIG. 5.

The switches 54 and 55 are therefore simply in parallel on the electrical power supply of the device 12.

To enable the plate 28 of the guard 24 to be inserted, the print head 16 of each of the printing stations 15 can move with respect to the turntable 11, substantially perpendicular to it, under the control of a control device 56, between a low position, in which, with the guard 24 in its retracted position, it is able to act upon the object held by the object support 13 present at such a printing station 15 and a high position, in which, as shown in FIG. 4, it allows the guard 24 to be in its extended position.

For example, and as shown, the control device 56 of the print head 16 includes an actuating cylinder 57, in practice a double action cylinder, which is held by the frame 20 of the whole assembly, with the non-visible piston of which the print head 16 moves in unison.

In the embodiment shown, the cylinder 57 is abutted to the plate 42 of the suspending rod 39.

As before, it can for example be a rodless cylinder.

Preferably, and this is the case in the embodiment shown diagrammatically in FIG. 5, it is through the intermediary of the control device 56 of the print head 16 that the control device 25 of the guard 24 is driven by the associated control unit 26.

For example, as shown diagrammatically in FIG. 5, the control unit 26 is a simple manually controlled switch which governs a solenoid valve 58 which in turn controls the actuating cylinder 57 in the control device 56 of the print head 16, and the actuating cylinder 44 in the control device 25 of the guard 24 is itself controlled by the previous actuating cylinder 57, the solenoid valve 59 governing it being actuated by the actuating cylinder 57 during its duty cycle.

Of course, the switch forming the control unit 26 is normally open, as shown in continuous outline in FIG. 5.

The same therefore applies to the switch 54.

The control device 12 of the turntable 11 cannot therefore receive power unless the switch 55 is closed, and therefore unless the gate 18 is itself closed.

However, an operator having to work on the print head 16 can at any time, according to the invention, by an intentional action, close the switch forming the control unit 26, as shown diagrammatically in dashed outline in FIG. 5.

Following the arrowed paths, shown diagrammatically in dashed outline in FIG. 5, the actuating cylinder 57 of the control device 56, under the control of the solenoid valve 58, then causes the print head 16 to be raised and then through the solenoid valve 59 the actuating cylinder 44 of the control device 25 to operate. The control device in turn causes the guard 24 to move from its retracted position to its extended position.

Previously open, the switch 54 now closes; for example, and preferably, this closure occurs when the guard 24 reaches the end of its travel.

The operator can then open the gate 18 without causing the turntable 11 to halt and without causing any risk to the operator since he is then protected from the turntable 11 by the guard 24.

After carrying out his work and again closing the gate 18, the operator returns, the switch forming the control unit 26 to the open position.

By a reverse procedure to that just described, the guard 24 is returned to the retracted position and the print head 16 is re-lowered.

When the guard 24 moves from its extended position to its retracted position, the plate 28 in the guard 24 is gradually raised by the actuating cylinder 44 from the side of the guide 33, pivoting around the guide 34 with which it remains engaged, as shown diagrammatically by the arrow F3 in FIG. 2, which, as already indicated, leads to the required overlap of this plate 28 with the immediately upstream plate 28.

In addition, it is clear that so that the operator can work on a print head 16, for example to adjust it, the print head 16 must be stationary.

For example, to achieve this, each of the print heads 16 in the printing machine according to the invention is an independent print head, that is a print head fitted with an individual control device independent from that of the turntable 11.

Since such independent print heads are well known in themselves, and as they are not in themselves relevant to the present invention, they are not described in detail here.

Of course, the present invention is not limited to the embodiment described and shown, but encompasses any variant executions thereof.

There is claimed:

1. Printing machine comprising a frame, a turntable for holding a series of object supports, each of the object supports being adapted to hold an object to be printed, a turntable control device for controlling the rotation of said turntable, at least one printing station having a print head, the said object supports being displaceable to said at least one printing station, a guard mounted mobile in a radial direction relative to said at least one printing station and disposed above and in the vicinity of said turntable, said guard being movable between a retracted position for ready access around said print head and an extended position for locally covering said turntable proximate to said print head, a guard control device for controlling said mobile guard, an operator accessible control unit for controlling said guard control device, said at least one printing station also including a gate mounted for movement with respect to the frame and for controlling access to said at least one printing station, a protection circuit for controlling said turntable control device, said protection circuit being interlocked with said gate, and interconnection means for disabling said protection circuit when said guard moves from the retracted position to the extended position.

2. Printing machine according to claim 1, wherein said guard includes a plate, said plate being substantially parallel to said turntable in the extended position of the guard, said plate having lateral edges substantially parallel to a radius of said turntable extending midway of said print head.

3. Printing machine according to claim 2, wherein guides are fastened to said frame cooperable with respective lateral edges of said plate.

4. Printing machine according to claim 3, wherein one of said guides has an L-shape cross-section cooperable with one of said lateral edges and the other of said guides has a recumbent U-shape cross-section cooperable with the other of said lateral edges.

5. Printing machine according to claim 3, wherein a suspending rod fastened to said frame overhangs said turntable and suspends said guides at associated ends thereof.

6. Printing machine according to claim 2, wherein in the extended position, said plate extends radially peripherally beyond of said turntable.

7. Printing machine according to claim 2, wherein said plate made of translucent material.

8. Printing machine according to claim 2, including at least two said printing stations disposed adjacent each other, a said guard equipping each of said two printing stations, said guards having respective plates locally overlapping each other in the retracted position when said two stations are in operation.

9. Printing machine according to claim 8, wherein one of said guides for each of said plate has an L-shape cross-section and the other of said guides has a recumbent U-shape cross-section, said control device including an actuating cylinder having a piston constrained to move in unison with the plate of the associated guard, said actuating cylinder extending obliquely with respect to said turntable and diverging from said turntable in a direction away from a peripheral edge of said turntable thereby ensuring local overlapping.

10. Printing machine according to claim 9, wherein said actuating cylinder comprises a rodless actuating cylinder.

11. Printing machine according to claim 9, wherein said actuating cylinder is located closer to said one lateral edge than said other lateral edge.

12. Printing machine according to claim 9, wherein said piston is constrained to move in unison by means of a coupling, said coupling acting at a radially innermost transverse edge of said plate.

13. Printing machine according to claim 12, wherein said coupling includes a ball-and-socket member.

14. Printing machine according to claim 1, wherein said guard control device comprises an actuator, said interconnection means including a switch controlled by said actuating cylinder, said switch being interposed between said turntable control device and a power supply therefor and connected in parallel with said protection circuit.

15. Printing machine according to claim 1, wherein said print head of said at least one printing station is movable substantially perpendicular to said turntable under the control of a control device for controlling said guard control device through said control unit.

16. In a printing machine comprising a frame, a turntable for holding a series of object supports, each of the object supports being adapted to hold an object to be printed, a turntable control device for controlling the rotation of said turntable, at least one printing station having a print head, said object supports being displaceable to each from said at least one printing station, a gate mounted for movement with respect to the frame and for controlling access to said at least one printing station, a protection circuit for controlling said turntable control device, said protection circuit being interlocked with said gate, the improvement wherein a guard is mounted mobile in a radial direction relative to said at least one printing station and disposed above and in the vicinity of said turntable, said guard being movable between a retracted position for ready access around said print head and an extended position for locally covering said turntable proximate to said print head, a guard control device for controlling said mobile guard, an operator accessible control unit for controlling said guard control device, and interconnection means for disabling said protection circuit when said guard moves from the retracted position to the extended position.

17. In a printing machine according to claim 16, wherein said guard includes a plate, said plate being substantially parallel to said turntable in the extended position of the guard, said plate having lateral edges substantially parallel to a radius of said turntable extending midway of said print head.

18. In a printing machine according to claim 16, wherein guides are fastened to said frame cooperable with respective lateral edges of said plate.

19. In a printing machine according to claim 18, wherein one of said guides ha s an L-shape cross-section cooperable with one of said lateral edges and the other of said guides has a recumbent U-shape cross-section cooperable with the other of said lateral edges.

20. In a printing machine according to claim 18, wherein a suspending rod fastened to said frame overhangs said turntable an d suspends said guides at associated ends thereof.

21. In a printing machine according to claim 17, wherein in the extended position, said plate extends radially peripherally beyond of said turntable.

22. In a printing machine according to claim 21, including at least two said printing stations disposed adjacent each other, a said guard equipping each of said two stations, said guards having respective plates locally overlapping each other in the retracted position when said two stations are in operation.

23. In a printing machine according to claim 18, wherein one of said guides for each of said plate has an L-shape cross-section and the other of said guides has a recumbent U-shape cross-section, said control device including an actuating cylinder having a piston constrained to move in unison with the plate of the associated guard, said actuating cylinder extending obliquely with respect to said turntable and diverging from said turntable in a direction away from a peripheral edge of said turntable thereby ensuring the local overlapping.

24. In a printing machine according to claim 22, wherein said actuating cylinder comprises a rodless actuating cylinder and said actuating cylinder is located closer to said one lateral edge than said other lateral edge.

25. In a printing machine according to claim 23, wherein said piston is constrained to move in unison by means of a coupling, said coupling acting at a radially innermost transverse edge of said plate.

26. Printing machine according to claim 16, wherein said guard control device comprises an actuator, said interconnection means including a switch controlled by said actuating cylinder, said switch being interposed between said turntable control device and a power supply therefor and connected in parallel with said protection circuit.

27. Printing machine according to claim 16, wherein said print head of said at least one printing station is movable substantially perpendicular to said turntable under the control of a control device for controlling said guard control device through said control unit.

* * * * *